US005942179A

United States Patent [19]

Tallentire et al.

[11] Patent Number: 5,942,179

[45] Date of Patent: Aug. 24, 1999

[54] POROUS FILM

[75] Inventors: Alan Tallentire, Wilmslow; Colin Samuel Sinclair, Rusholme, both of United Kingdom

[73] Assignee: Rexam Medical Packaging Limited, London, United Kingdom

[21] Appl. No.: 08/702,494

[22] PCT Filed: Mar. 1, 1995

[86] PCT No.: PCT/GB95/00431

§ 371 Date: Jan. 13, 1997

§ 102(e) Date: Jan. 13, 1997

[87] PCT Pub. No.: WO95/23888

PCT Pub. Date: Sep. 8, 1995

[30] Foreign Application Priority Data

Mar. 1, 1994 [GB] United Kingdom ..... 9403911

[51] Int. Cl.[6] ..... B29C 67/20; D04H 1/54

[52] U.S. Cl. ..... 264/322; 28/116; 28/134; 38/144; 264/324

[58] Field of Search ..... 28/103, 106, 116, 28/134; 38/144; 264/103, 125, 234, 319, 322, 324; 428/219, 311.11, 311.51, 315.5, 315.7, 317.7, 338; 442/181, 221, 226, 327, 370, 374, 409, 411

[56] References Cited

U.S. PATENT DOCUMENTS

| | | | |
|---|---|---|---|
| 4,147,825 | 4/1979 | Talalay | 428/138 |
| 4,840,733 | 6/1989 | Sasaki et al. | 210/500.41 |
| 4,874,568 | 10/1989 | Chau et al. | 264/49 |
| 4,923,660 | 5/1990 | Willenberg et al. | 264/103 |
| 4,987,024 | 1/1991 | Greensberg et al. | 428/219 |
| 5,066,531 | 11/1991 | Legg et al. | 428/131 |
| 5,135,804 | 8/1992 | Harpell et al. | 428/357 |
| 5,173,235 | 12/1992 | Kamei et al. | 264/154 |

FOREIGN PATENT DOCUMENTS

| | | |
|---|---|---|
| 0 116 845 | 8/1984 | European Pat. Off. . |
| 0 201 029 | 11/1986 | European Pat. Off. . |
| 27 39 705 | 3/1978 | Germany . |
| 2 195 266 | 4/1988 | United Kingdom . |

*Primary Examiner*—Blaine Copenheaver
*Attorney, Agent, or Firm*—Larson & Taylor

[57] ABSTRACT

A method of producing a porous film comprises subjecting a fibrous material comprised of fibers of a film forming material to conditions of heat and pressure to covert the fibrous material to a porous film. The method allows the production of film material having substantially uniform pore sizes. For example, the pore size distribution of the film may be such as to have a ratio of maximum pore size:mean flow pore of less than 1.2, e.g., less than 1.1.

11 Claims, 3 Drawing Sheets

POROUS FILM

TECHNICAL FIELD

The present invention relates to porous films, methods of producing such film, and uses of such films. (Note: the term 'porous' is used herein, unless the context requires otherwise, to mean 'possessing through-pores'.)

BACKGROUND ART

Conventional films of plastics materials are generally essentially non-porous. Thus they are commonly used to provide impermeable barriers. A thin film can be of good mechanical strength.

Porous webs of fibrous materials are well-known, e.g. papers and both woven and non-woven webs. Such materials have pores with wide size ranges. Some pores will be very large, so that barrier properties will be significant only if the materials are thick, so that the pores are long and convoluted. Thin webs will have poor barrier properties and are also likely to have poor mechanical strength (particularly with non-woven webs).

In the production of non-woven webs, an initially-produced loose web is commonly compacted by calendering. This may be carried out under conditions of temperature and pressure such that there is some bonding of fibres, thus producing a stabilised fibrous web, e.g. as described in EP-A-0116845. That document also discloses the treatment of polyethylene fibre webs under more severe conditions to convert them to impermeable films. This is not generally a useful technique. If a film of a plastics material is required, it is cheap and easy to produce it directly from a melt (by extrusion and, if necessary, stretching). It is more expensive to extrude fibres and convert these to a non-woven web, and a further conversion step would add to the expense.

Composite webs with a film bonded to a fibrous web are also known. They may be treated so that the film becomes apertured, giving the composite some limited permeability (e.g. U.S. Pat. No. 4,684,568: treatment by calendering; U.S. Pat. No. 4,898,761: needling of the film). Such materials have low permeability, are quite expensive to produce, and are of limited applicability.

We have appreciated that there would be many potential uses for porous films with controlled pore sizes, particularly if they were 'breathable', i.e. of substantial permeability. For example, medical and surgical items are generally supplied in a sterile state enclosed within individual packages fabricated in part from porous materials. Such porous materials are of necessity permeable to gases and vapours so as to permit sterilisation of the item (after packaging) by means of steam or a gas such as ethylene oxide. Furthermore, permeability to air is important to allow the application of a vacuum during sterilisation, to facilitate the packaging process and to limit the air volume around the packaged item. However, in spite of this air permeability the material must act as an effective barrier to the passage of micro-organisms to that the packaged item remains sterile. Conventional polymeric films possess little or no gas permeance and consequently their use is limited to forming a non-porous part of a medical package.

Other examples of potential uses for porous films with controlled pore sizes include filtration (e.g. of particles from liquids) and controlled release of vapours.

The natural assumption is that if you subject a web having pores of a range of sizes to sufficient heat and pressure, the result will be a general reduction in the sizes of the pores, leading to a progressive closing of pores, starting with the smallest ones. It could not have been predicted whether it would be possible to isolate part-treated materials (before complete closure of all pores). But there was no incentive to try, since the materials would not be expected to be of interest. They would be expected to have lost most of their permeability, owing to the general reduction in pore sizes; they would also be expected to have lost most of their barrier properties, since the inevitable reduction in thickness would have removed most of their ability to act as depth filters, whereas the pore size distribution would mean that they still possessed a proportion of relatively large pores.

DISCLOSURE OF THE INVENTION

Surprisingly we have now found that it is possible to convert a fibrous web into a porous film in which the pore size distribution is controlled, and may bear little resemblance to that of the original web. In a particularly preferred type of embodiment, a fibrous web having a wide range of pore sizes (e.g. being a non-woven web with a log-normal distribution) is converted into a film having substantially uniform pores. It is not that all but the largest pores have closed up: their number is so small that such a material would be virtually non-porous. By some mechanism which we do not yet fully understand, a large number of pores, originally of many sizes are converted to pores of what is virtually a single size. The result can be a true membrane filter: a thin film which has the ability to act as a filter by a sieving mechanism. Known so-called membrane filters are, in fact, much farther from this ideal.

According to a first aspect of the present invention there is provided a method of producing a porous film comprising subjecting a fibrous material comprised of fibres of a film forming material to conditions of heat and pressure to convert said fibrous material to a porous film.

The conditions may be selected by subjecting samples of the material to treatment at a range of temperatures and/or pressures, monitoring the air permeance or a related parameter of the treated samples thereby to determine conditions for forming porous films; and then carrying out the production of porous film under such conditions.

The method of the invention results in a porous, and preferably breathable, film. The pores in the film are preferably of uniform pore size. Their nature depends on the conditions of treatment such as temperature, pressure and time. It also depends on the properties of the web of fibrous material, e.g. the chemical nature and physical properties such as fibre diameter and "substance" (i.e. the openness and/or thickness of the web, affecting the mass per unit area).

The invention is mainly, though not exclusively, concerned with the conversion of non-woven webs, including melt-blown webs and spun-bonded webs.

The term 'pore size' has its conventional meaning, i.e. for a given pore, it is the minimum cross-sectional size throughout the length of the pore. For a given sample of material, pore size distribution is represented by a differential flow distribution (percentage differential flow vs pore size) in which maximum pore size is the diameter of the pore of largest minimum cross-sectional area, minimum pore size is the diameter of the pore of smallest cross-section area, and mean flow pore is the diameter of the pore through which 50% of the cumulative gas flow passes across the sample. The ratio of the maximum pore size to the mean flow pore is a measure of the effective pore size range within the material. Pore size distributions can be measured by conventional fluid displacement techniques.

It is preferred that the application of heat and pressure to the fibrous material is effected at a nip through which the fibrous material passes. Thus a preferred method practising the invention is to calender the material.

Generally, both rolls of the calender are heated. It is desirable that both faces of the web should be thermally and mechanically treated. Thus the method is generally to be applied to single-layer webs and not laminates.

The conditions of temperature and pressure employed in the method of the invention are sufficient to convert the fibrous material to a porous film; this conversion is also referred to herein as 'film-forming'. We have found that there is a critical combination of temperature and pressure above which the method of the invention becomes operative to produce the porous film. The conditions required to 'film-forming' porous webs will vary from web type to web type but will be readily ascertained by a person skilled in the art. We have found for example that calendering at a pressure above 250 pound per linear inch (pli) (45 kg/cm) at temperature in excess of 50° C. (e.g. 70–100° C.) is suitable for a number of polymers. The final film will generally differ from the fibrous web in that the latter will generally be opaque whereas the former will have a degree of transparency.

A wide variety of porous webs comprising fibres can be used in the present invention. The fibres are preferably of a polymeric material. For example, the porous web may comprise one or more of the following polymeric fibres: polyethylene, polypropylene, polyurethane, nylon, polyester, rayon, co polymer, EVA, EMA (ethyl methacrylate) and EVOH (ethylene vinyl alcohol). (The specific requirement is that the fibre is capable of 'film-forming'.) In addition, the polymeric fibre may include chemical additives such as fluorochemicals, colour agents, and antimicrobial agents. Different fibre types will require different temperature/pressure conditions to effect film/forming. Use may be made of multiconstituent fibres, i.e. fibres with definable phase boundaries between different constituents. Examples of classes of biconstituent fibres include sheath-core, side-by-side, and matrix fibril fibres. For example a web of sheath-core or other multiconstituent fibres could be processed under conditions such that one or more constituents formed a film, in which fibres of at least one other constituent remained e.g. as reinforcement. Use may be made of multi-denier melt-bonded webs.

The web may be a non-woven material or a woven material. Ideally the material has a weight in excess of 15 $gm^{-2}$. This is for very fine (sub-$\mu$m) fibres. Coarser fibres have higher minima. Other things being equal, a heavier web (thicker and/or a higher concentration of fibres) gives a film with smaller pores.

The method of the invention allows the production of porous film having a pore structure comprising pores which are substantially uniform in size. Thus, for example, the method of the invention allows the production of porous films in which the ratio of maximum pore size: mean flow pore is less than 1.2, more preferably less than 1.1. Our preliminary work has included the preparation of materials with a ratio as low as 1.005, and it is clear that it will be possible to better this. But in practice, for most purposes, a ratio of 1.05 (or below) represents essential uniformity of pore size. Such porous films are believed to be novel and therefore according to a second aspect of the present invention there is provided a porous film material wherein the pore size distribution has a ratio of maximum pore size: mean flow pore of less than 1.2.

A particular application of the invention is to produce films having a pore structure that comprises pores which are substantially uniform in size. These uniform pore structures are characteristic of 'film-formed' webs and yield porous films with controlled barrier function.

MODES FOR CARRYING OUT THE INVENTION

The following examples are provided to illustrate the invention. We used a laboratory calender, only one of whose rolls was heated. Therefore the material was passed through twice, with inversion between passes. The conditions were:

| | |
|---|---|
| nip pressure | 700 pli (130 Kg/cm) |
| number of nips | 1 |
| porous web width | 30 cm |
| speed | 10 m/min |
| size of test samples | 17.3 $cm^2$ |

EXAMPLE 1

Figure 1:
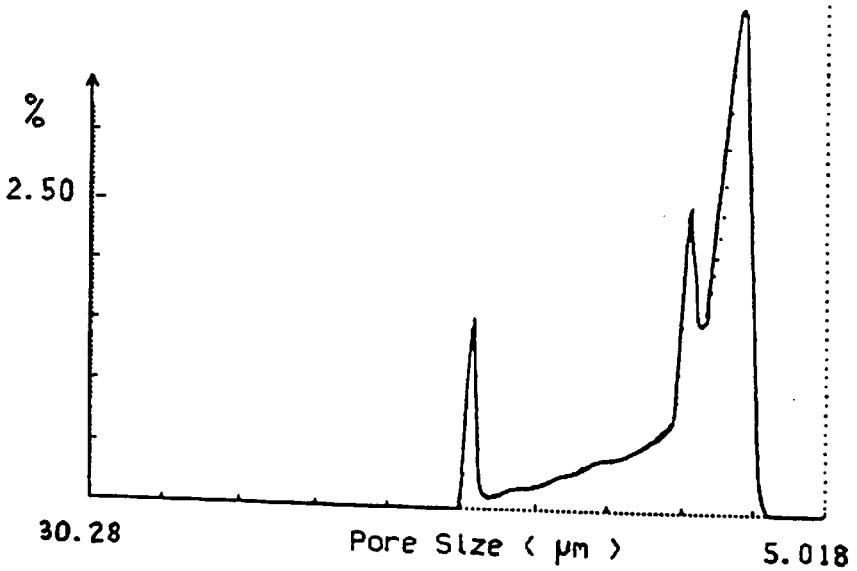
FIGS. 1, 2 and 3 are graphs showing differential flow distribution through samples of the web 'A' used in Example 1 before treatment, after treatment at 20°, and after treatment 90°.

A 50 $Cm^{-2}$ melt-blown polymeric web (designated web A), fabricated from polyethylene fibres, was calendered employing the above conditions. The method was carried out at varying roller temperatures (ranging from 20 to 90° C.) so as to provide different calendering conditions. Prior to calendering, web A had an air permeance of around 30,000 Bendtsen and a pore size distribution as depicted in FIG. 1. The distribution is log normal and is quite wide, the minimum and maximum sizes being 7.2 and 17.3 $\mu$m and the mean flow pore size being 9.1 $\mu$m. Treatment with a nip temperature of 20° C. gave a web with an air permeance of 2,050 Bendtsen. Over the nip temperature range 20–50° C., air permeance is observed to fall slightly with increasing temperature. However, between 50 and 80° C. nip temperature, there is a marked change in the air permeance of the calendered web with a level of around 600 Bendtsen being achieved at a nip temperature of 90° C. and above. The overall response can be considered to fall into the distinct behaviours:

20–50° C.—web consolidation (no film formation)

50–80° C.—transition stage between web consolidation and film formation

80–100° C.—film formation

Figure 2:
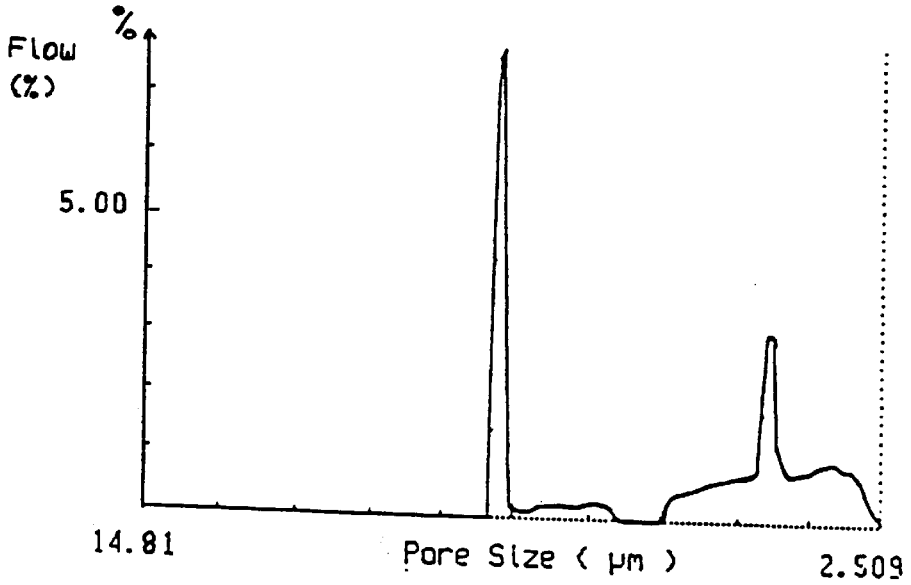
Figure 3:
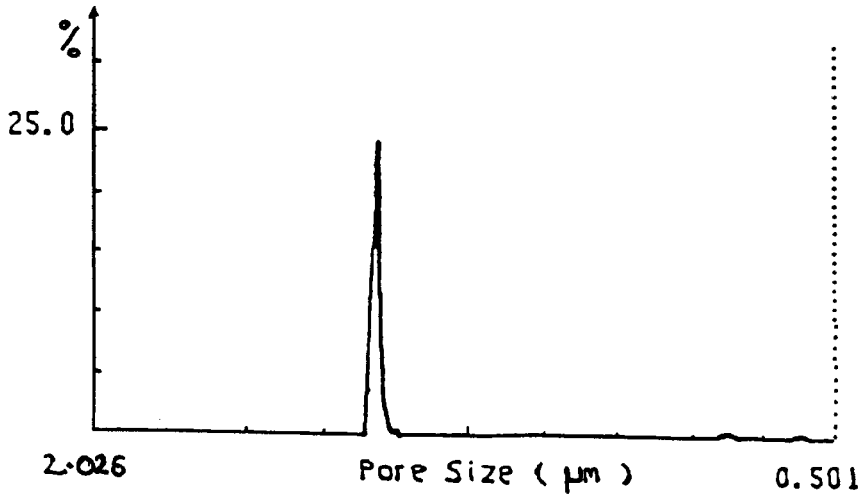
Figure 4:
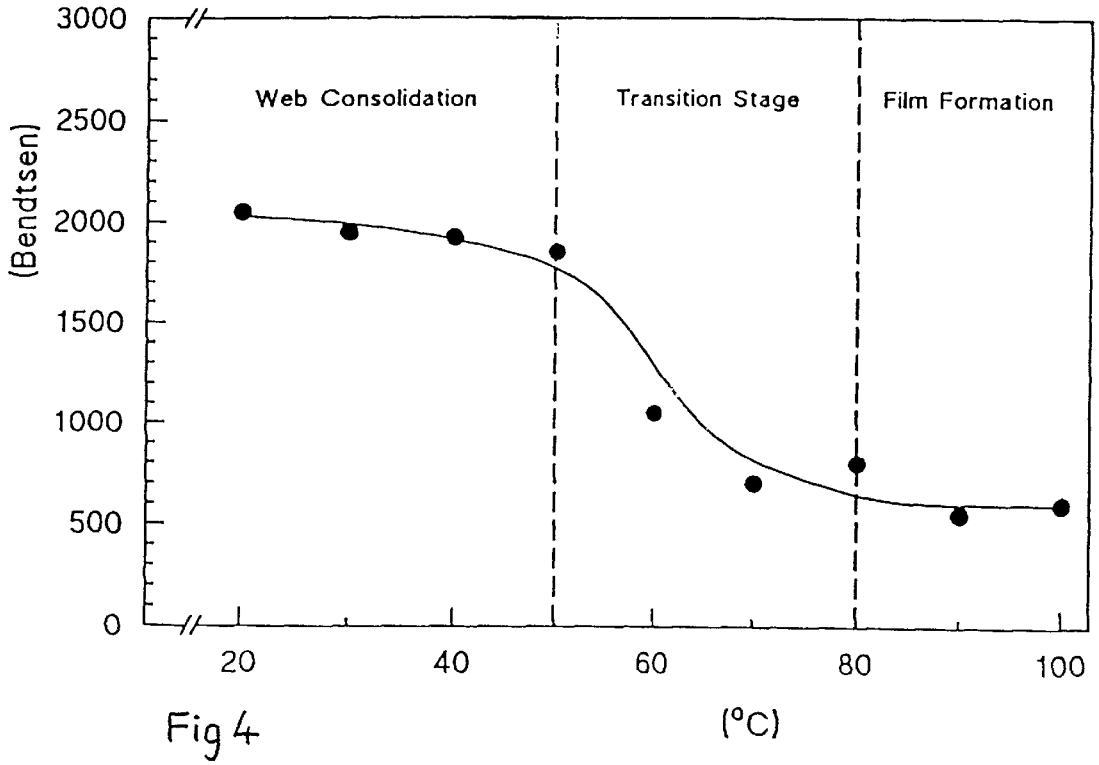
FIGS. 4 and 5 are graphs showing how the treatment temperature in Example 1 affected air pressure and the ratio of maximum pore size; mean flow pore.
Figure 5:
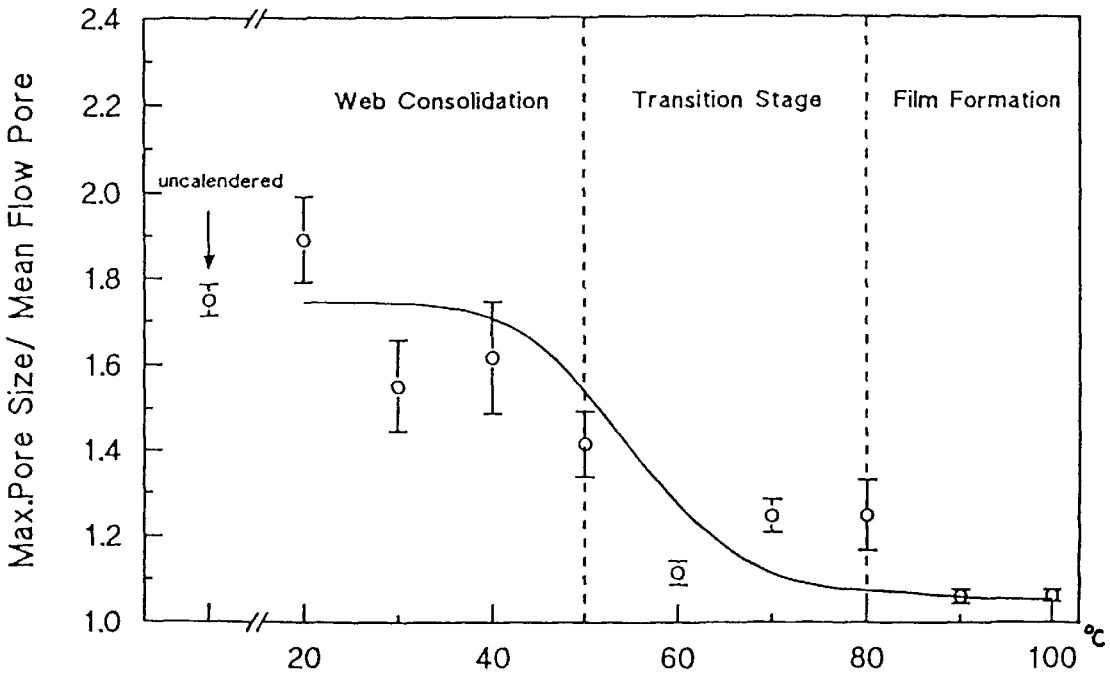

FIGS. 2 and 3 give the pore size distribution data generated for consolidated web A (nip temperature at 20° C.) and 'film-formed' web A (nip temperature at 90° C.) respectively. The consolidated web shows a log normal pore size distribution like that of the uncalendered polymeric web though compressed so that the corresponding maximum, minimum and mean values are 8.9, 2.9 and 4.9 $\mu$m. In contrast, the film-formed web has a very narrow pore size distribution. The mean size (1.43) hardly differs from the maximum size (1.46). The minimum size is 0.57 $\mu$m. Thus the pores are substantially uniform in size. Percentage differential flow peaks at around 23% for the film-formed web as opposed to 8% for the consolidated web. This dramatic change in pore size distribution, due to operation of the method of the invention, is further shown by the ratio of maximum pore size to mean flow pore. FIG. 5 is a plot of the ratio of maximum pore size and mean flow pore vs nip temperature for web A. Points are mean values of five determinations. (Bars represent standard error of mean values.) For comparative purposes the maximum/mean pore ratio for the uncalendered polymeric web is also included. It is seen from FIG. 5 that the maximum/mean pore ratio is around 1.75 for the uncalendered web A. Over the nip temperature range corresponding to web consolidation (up to 50° C.), this ratio remains effectively constant. However, on attaining the nip temperature to initiate film-formation (around 50° C. for web A at 700 pli) the maximum/mean pore ratio falls progressively to achieve a value of around 1.05 at the film-forming nip temperatures of 90° C. and above. In practice, a maximum/mean pore ratio of 1.05 indicates a pore structure comprising pores substantially of the same size.

EXAMPLE 2

A 40 $gm^2$ melt-blown polymeric web (designated web B), fabricated from polypropylene fibres, was calendered employing nip pressure of 700 pli at temperatures ranging from 20 to 110° C. Table 1 lists data generated for calendered web B at four different nip temperatures together with data for uncalendered web B.

| Nip Temperature (° C.) | Air Permeance (Bendsten) | Max. Pore Size Mean Flow Pore |
|---|---|---|
| uncalendered | 34,832 | 1.32 |
| 20 | 20,899 | 1.46 |
| 50 | 8,147 | 1.46 |
| 90 | 2,366 | 1.53 |
| 110 | 428 | 1.03 |

Figure 6:
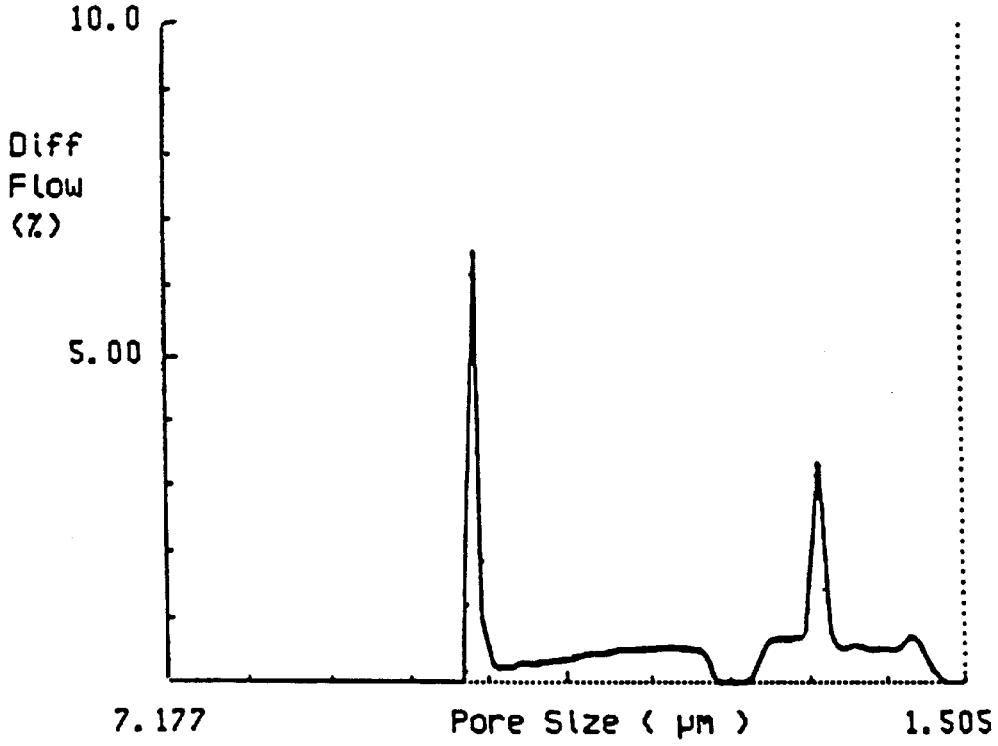
FIGS. 6 and 7 are graphs showing differential flow distribution through samples of the web 'B' used in Example 2 after treatment at 90° and 110° respectively.
Figure 7:
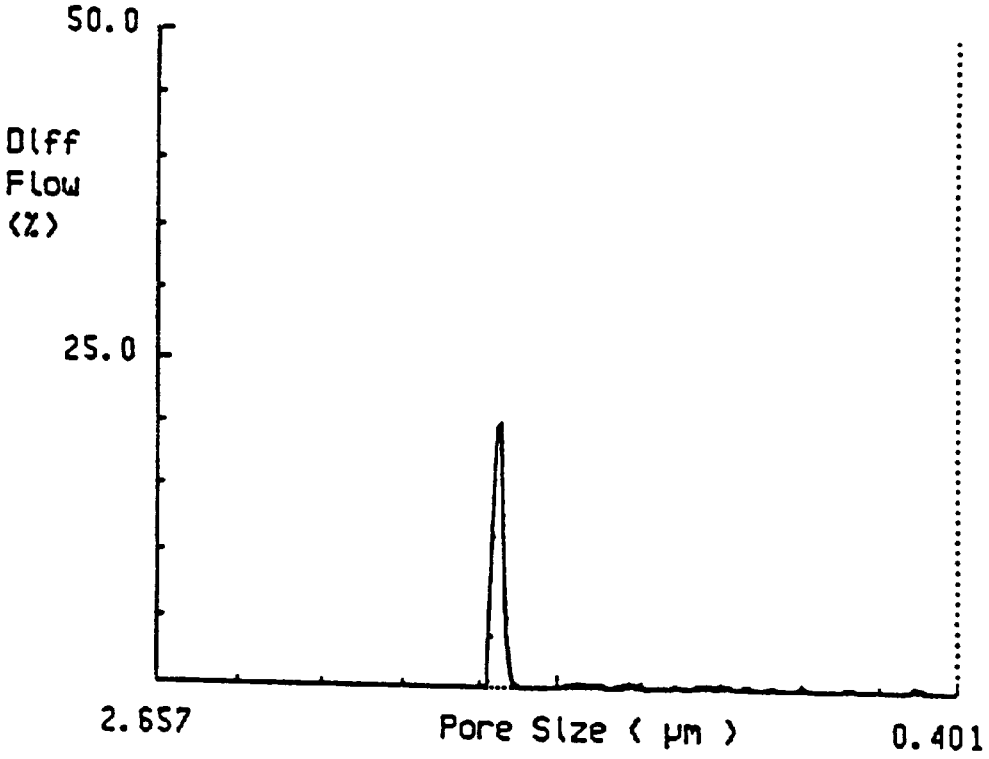

For web B, employing nip pressure of 700 pli, a nip temperature of 110° C. is identified to yield a 'film-formed' web comprising substantially uniform pores (a maximum/mean flow pore ratio of 1.03 as opposed to a ratio of around 1.32 for uncalendered web B and around 1.48 for web B consolidated at nip temperatures up to and including 90° C.) FIGS. 6 and 7 show pore size distributions for web B calendered at nip temperatures of 90 and 110° C. respectively. Note that the graph for treatment at 90° C. (FIG. 6) shows a small peak at about 1.6 $\mu$m with almost all pores being larger. But with treatment at 110° (FIG. 7), this peak at about 1.6 $\mu$m now dominates. There is practically nothing else. All of the pores have become of this size.

As in Example 1, percentage differential flow is observed to peak at a substantially higher level of around 20% for the 'film-formed' web (nip temperature of 110° C.) as opposed to around 7% for the consolidated web (nip temperature of 90° C.). This difference is in keeping with the method of the invention in which a polymeric web is converted to a porous film comprising pores of substantially uniform size.

From the permeance values and the pore sizes, it is possible to calculate the numbers of pores in the film-formed products. For the "converted" films of examples 1 and 2 these values are 8.5 and $3.4\times10^6$ pores/$cm^2$. These figures are probably imprecise, but it is no doubt the case that the films had of the order of 1–10 million pores per square centimeter. If the holes were direct cylindrical openings, the values for 1 and 2 would correspond to 14% and 7% of the surface area being occupied by openings.

We claim:

1. A method of producing a porous film comprising providing a single-layer web of a fibrous material comprising fibers of a film-forming material, said web having a pair of opposite faces, and thermally and mechanically treating both of said faces of the web so that said fibrous material of said web is subjected to conditions of heat and pressure such that fibrous material is converted into a porous film which has a ratio of maximum pore size:mean flow pore of less than 1.2 to 1.

2. A method according to claim 1, wherein said conditions are selected by subjecting samples of the single-layer web of fibrous material to treatment at a range of temperatures and/or pressures, monitoring the air permeance of the treated samples thereby to determine conditions of temperature and/or pressure for forming porous films; and then carrying out the production of porous film under such conditions.

3. A method according to claim 1 wherein the fibers comprise a polymeric material.

4. A method according to claim 3 wherein the polymeric material is or includes a material selected from the group consisting of polyethylene, polypropylene, polyurethane, polyamide, polyester and rayon.

5. A method according to claim 3 wherein the polymeric material is or includes a polymeric material selected from the group consisting of ethylene-vinyl acetate (EVA), ethyl methacrylate (EMA) and ethylene-vinyl alcohol (EVOH).

6. A method according to claim 1 wherein the heat and pressure are applied by calendaring the fibrous material.

7. A method according to claim 6 wherein calendaring is performed by passing said web of fibrous material through at least one nip between a pair of rollers which contact said opposed faces thereof, each said face being contacted by a heated roller.

8. A method according to claim 6 wherein the calendaring is performed using a pressure in excess of 250 pli (pounds per linear inch) (45 kg/cm) at a temperature in excess of 50° C.

9. A method according to claim 1 wherein the fibrous material is a non-woven material.

10. A method according to claim 1 wherein the fibrous material is a woven material.

11. A method according to claim 1 wherein the fibrous material contains fibers of different diameters and/or different materials.

* * * * *